US008301383B2

(12) United States Patent
Birchwood et al.

(10) Patent No.: US 8,301,383 B2
(45) Date of Patent: Oct. 30, 2012

(54) ESTIMATING IN SITU MECHANICAL PROPERTIES OF SEDIMENTS CONTAINING GAS HYDRATES

(75) Inventors: Richard Anthony Birchwood, Houston, TX (US); Rishi Dev Singh, Houston, TX (US); Ali Mese, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 422 days.

(21) Appl. No.: 12/467,545

(22) Filed: May 18, 2009

(65) Prior Publication Data

US 2010/0017136 A1 Jan. 21, 2010

Related U.S. Application Data

(60) Provisional application No. 61/058,155, filed on Jun. 2, 2008.

(51) Int. Cl.

| | |
|---|---|
| ***G01V 11/00*** | (2006.01) |
| ***G01V 3/18*** | (2006.01) |
| ***G01V 9/00*** | (2006.01) |
| ***G01V 1/40*** | (2006.01) |
| ***E21B 47/00*** | (2011.01) |

(52) U.S. Cl. ..... 702/11; 702/6; 702/9; 73/152.01; 367/25

(58) Field of Classification Search ..... 702/6, 9, 702/11; 700/159, 160, 173; 73/182.14, 152.03, 73/152.14, 152.01, 152.43, 152.54; 175/24, 175/39; 367/25, 35, 86

See application file for complete search history.

(56) References Cited

U.S. PATENT DOCUMENTS

| | | | |
|---|---|---|---|
| 5,385,452 | A | 1/1995 | Lyday |
| 5,999,887 | A | 12/1999 | Giannakopoulos et al. |
| 6,044,327 | A | 3/2000 | Goldman |

(Continued)

FOREIGN PATENT DOCUMENTS

| | | | |
|---|---|---|---|
| CA | 2558627 | A1 | 1/2005 |

(Continued)

OTHER PUBLICATIONS

Eissa, E.A. & Kazi, A. (1988) Relation between static and dynamic Young's moduli for rocks. Int. J. Rock Mech. Min. Sci. & Geomech. Abstr. 25, 479-482.

(Continued)

*Primary Examiner* — Michael Nghiem
*Assistant Examiner* — Ricky Ngon
(74) *Attorney, Agent, or Firm* — Colin Wier

(57) ABSTRACT

A method for constructing elastoplastic property correlations in multicomponent particulate systems. The method includes obtaining parameters from geophysical data of a sediment-hydrate system, where the parameters include $s_{hyd}$ and $p_c$, and where $s_{hyd}$ is a hydrate saturation and $p_c$ is a confining pressure. The method further includes determining a Young's modulus (E) of the sediment-hydrate system using the parameters and a correlation, where the correlation is $$\frac{E}{p_c} = 90.58 + \frac{78.90}{\alpha^{0.5831}} + \frac{800.4 s_{hyd}^{1.371}}{\alpha^{1.022}},$$

and where $\alpha = p_c/c$ and c is a scaling variable with dimensions of pressure. The method further includes adjusting a field operation based on the Young's modulus of the sediment-hydrate system.

20 Claims, 5 Drawing Sheets

U.S. PATENT DOCUMENTS

| | | | | |
|---|---|---|---|---|
| 6,704,656 | B1 | 3/2004 | Abriol et al. | |
| 7,035,778 | B2 | 4/2006 | Goldman et al. | |
| 7,085,696 | B2 | 8/2006 | King | |
| 7,261,167 | B2 | 8/2007 | Goldman et al. | |
| 7,357,196 | B2 | 4/2008 | Goldman et al. | |
| 7,359,845 | B2 | 4/2008 | Kelfoun | |
| 7,472,022 | B2 * | 12/2008 | Birchwood | 702/9 |
| 7,486,589 | B2 * | 2/2009 | Lee et al. | 367/35 |
| 2005/0090986 | A1 * | 4/2005 | Van Riel et al. | 702/6 |

FOREIGN PATENT DOCUMENTS

| | | | |
|---|---|---|---|
| CA | 2542416 | A1 | 5/2005 |
| EP | 1612370 | A1 | 1/2006 |
| JP | 03-279886 | | 12/1991 |

OTHER PUBLICATIONS

Montmayour, H. & Graves, R.M. (1986) Prediction of Static Elastic/Mechanical Properties of Consolidated and Unconsolidated Sands From Acoustic Measurements: Correlations. 61st Annual Technical Conference and Exhibition of the Society of Petroleum Engineers, New Orleans, LA. SPE 15644.

Morales, R.H. & Marcinew, R.P. (1993) Fracturing of high-permeability formations: Mechanical properties correlations. SPE 26561.

Yale, D.P. & Jamieson, W.H. (1994) Static and Dynamic Rock Mechanical Properties in the Hugoton and Panoma Fields, Kansas. SPE Mid-Continent Gas Symposium, Amarillo, TX., SPE 27939.

Tutuncu, A.N. & Sharma, M.M. (1992) Relating Static and Ultrasonic Laboratory Measurements to Acoustic Log Measurements in Tight Gas Sands. 67th Annual Technical Conference and Exhibition of the Society of Petroleum Engineers, Washington, DC, SPE 24689.

Krief, M., Garat, J., Stellingwerff, J., & Ventre, J. (1990) A petrophysical interpretation using the velocities of P and S waves (full-waveform sonic). The Log Analyst 31, November, 355-369.

Chang, C. (2004) Empirical Rock Strength Logging in Boreholes Penetrating Sedimentary Formations. MULLI-TAMSA (Geophysical Exploration) 7, 174-183.

Plumb, R.A., Herron S.L. & Olsen, M.P. (1992) Influence of Composition and Texture on Compressive Strength Variations in the Travis Peak Formation. 67th Annual Technical Conference and Exhibition of the Society of Petroleum Engineers, Washington, D.C. SPE 24758.

Qiu, K., Marsden, J.R., Solovyov, Y., Safdar, M. & Chardac, O. (2005) Downscaling Geomechanics Data for Thin Bed Using Petrophysical Techniques. 14th SPE Middle East Oil and Gas Show and Conference, Bahrain. SPE 93605.

Collett, T.S. & Dallimore, S.R. (2002) Detailed analysis of gas hydrate induced drilling and production hazards. 4th International Conference on Gas Hydrates (ICGH-4), Yokohama, 6 pages.

Franklin, L.J. (1981) Hydrates in Artic Islands. In: A.L. Browser (ed.) Proceedings of a Workshop on Clathrates (gas hydrates) in the National Petroleum Reserve in Alaska. USGS Open-File Report 81-1259, 18-21, 163 pages.

Yang, J., Tohidi, B., & Clennell, B. M. (2004) Micro and macro-scale investigation of cementing characteristics of gas hydrates. AAPG Hedburg Research Conference, Vancouver, Sep. 12-16, 4 pages.

Darve, F. & Nicot, F. (2005) On incremental non-linearity in granular media: phenomenological and multi-scale views (Part I) International Journal for Numerical and Analytical Methods in Geomechanics, 29, 23 pages.

Emeriault, F. & Claquin, C. (2004) Statistical homogenization for assemblies of elliptical grains: effect of the aspect ratio and particle orientation International Journal of Solids and Structures, 41, 13 pages.

Gardiner, B.S. & Tordesillas, A. (2004) Micromechanics of shear bands. International Journal of Solids and Structures, 41, 17 pages.

Sayers, C.M. (2002) Stress-dependent elastic anisotropy of sandstones. Geophysical Prospecting, 50, 11 pages.

Tordesillas, A. & Walsh, S. (2002) Incorporating rolling resistance and contact anisotropy in micromechanical models of granular media. Powder Technology, 124, 23 pages.

Pinson, D., Zou, R.P., Yu, A.B., Zulli, P. & McCarthy, M.J. (1998) Coordination number of binary mixtures of spheres. J. Phys. D, 31, 6 pages.

Bardet, J.P. & Proubet, J. (1991) A numerical investigation of the structure of persistent shear bands in granular media. Geotechnique, 41, 15 pages.

Mavko, G., Mukerji, T., and Dvorkin, J. (1998) The Rock Physics Handbook. Cambridge University Press, 162-213.

Suzuki, M. & Oshima, T. (1985) Co-ordination number of a multicomponent randomly packed bed of spheres with size distribution. Powder Technol. 44, 6 pages.

Ouchiyama, N. & Tanaka, T. (1980) Estimation of the average number of contacts between randomly mixed solid particles. Ind. Eng. Chem. Fundam. 19, 3 pages.

Dodds, J. A. (1980) The porosity and contact points in multicomponent random sphere packings calculated by a simple statistical geometric model. J. Colloid Interface Sci. 77, 6 pages.

Canadian Intellectual Property Office Examination Report of Canadian Patent Application No. 2,659,594 dated Apr. 24, 2012.

Richard Birchwood et al., "Wellbore Stability Model for Marine Sediments Containing Gas Hydrates", AADE-05-NTCE-13, Proceedings of the American Association for Drilling Engineers 2005 National Technical Conference and Exhibition, Held Apr. 5-7, 2005 in Houston (AADE, 2005).

International Search Report and Written Opinion of PCT/US2007/077292 dated Feb. 13, 2008.

First Office Action of Japanese Patent Application No. 2009-526919 dated Apr. 3, 2012.

* cited by examiner

ESTIMATING IN SITU MECHANICAL PROPERTIES OF SEDIMENTS CONTAINING GAS HYDRATES

CROSS-REFERENCE TO RELATED APPLICATIONS

This application claims benefit of U.S. Provisional Patent Application No. 61/058,155, filed on Jun. 2, 2008, and entitled "Method and System for Estimating In Situ Mechanical Properties of Sediments Containing Gas Hydrates," which is hereby incorporated by reference.

Further, this application is related to U.S. Pat. No. 7,472,022, issued on Dec. 30, 2008, entitled "Method and System for Managing a Drilling Operation in a Multicomponent Particulate System," which is hereby incorporated by reference.

BACKGROUND

FIG. 1 shows a diagram of a field operation, in which a drilling rig (100) is used to turn a drill bit (150) coupled at the distal end of a drill pipe (140) in a borehole (145). The field operation may be used to obtain oil, natural gas, water, or any other type of material obtainable through drilling or otherwise obtained. Although the field operation shown in FIG. 1 is for drilling directly into an earth formation, those skilled in the art will appreciate that other types of field operations also exist, such as lake drilling, deep sea drilling, exploration operations, exploitation operations, completion operations, production operations, processing operations, etc.

As shown in FIG. 1, rotational power generated by a rotary table (125) is transmitted from the drilling rig (100) to the drill bit (150) via the drill pipe (140). Further, drilling fluid (also referred to as "mud") is transmitted through the drill pipe's (140) hollow core to the drill bit (150). Specifically, a mud pump (180) is used to transmit the mud through a stand pipe (160), hose (155), and kelly (120) into the drill pipe (140). To reduce the possibility of a blowout, a blowout preventer (130) may be used to control fluid pressure within the borehole (145). Further, the borehole (145) may be reinforced using a casing (135), to prevent collapse due to a blowout or other forces operating on the borehole (145). The drilling rig (100) may also include a crown block (105), traveling block (110), swivel (115), and other components not shown.

Mud returning to the surface from the borehole (145) is directed to mud treatment equipment via a mud return line (165). For example, the mud may be directed to a shaker (170) configured to remove drilled solids from the mud. The removed solids are transferred to a reserve pit (175), while the mud is deposited in a mud pit (190). The mud pump (180) pumps the filtered mud from the mud pit (190) via a mud suction line (185), and re-injects the filtered mud into the drilling rig (100). Those skilled in the art will appreciate that other mud treatment devices may also be used, such as a degasser, desander, desilter, centrifuge, and mixing hopper. Further, the drilling operation may include other types of drilling components used for tasks such as fluid engineering, drilling simulation, pressure control, wellbore cleanup, and waste management.

In a given field operation (e.g., the drilling operation shown in FIG. 1), knowledge about the geomechanical properties of formations may be used to mitigate various field-related challenges. For example, some formations may present a risk of rock deformation or failure. Plasticity parameters are typically measured directly using mechanical tests performed on cores, while brittle-elastic properties may be predicted using mathematical correlations.

For example, methods for estimating the static Young's modulus are described in the following papers: "Relation between static and dynamic Young's moduli for rocks" by Eissa, E. A. & Kazi, A. found in *Int. J. Rock Mech. Min. Sci. & Geomech. Abstr.* 25 (1988) at pages 479-482; "Prediction of Static Elastic/Mechanical Properties of Consolidated and Unconsolidated Sands From Acoustic Measurements: Correlations" from the 61*st Annual Technical Conference and Exhibition of the Society of Petroleum Engineers*, New Orleans, La. (1986) SPE 15644 by Montmayour, H. & Graves, R. M.; "Fracturing of high-permeability formations: Mechanical properties correlations" SPE 26561 (1993) by Morales, R. H. & Marcinew, R. P.; "Static and Dynamic Rock Mechanical Properties in the Hugoton and Panoma Fields, Kansas" from the SPE Mid-Continent Gas Symposium, Amarillo, Tex., SPE 27939 (1994) by Yale, D. P. & Jamieson, W. H.; and "Relating Static and Ultrasonic Laboratory Measurements to Acoustic Log Measurements in Tight Gas Sands" from the 67$^{th}$ *Annual Technical Conference and Exhibition of the Society of Petroleum Engineers*, Washington, D.C., SPE 24689 (1992) by Tutuncu, A. N. & Sharma, M. M.

Further, methods for estimating the static Poisson's ratio from the dynamic Poisson's ratio are described in Tutuncu & Sharma (1992) (referenced above) and Yale & Jamieson (1994) (referenced above). An empirical correlation for evaluating the Biot's constant is described in a paper by Krief, M., Garat, J., Stellingwerff, J., & Ventre, J. entitled "A petrophysical interpretation using the velocities of P and S waves (full-waveform sonic)" found in The Log Analyst 31, dated November 1990 at pages 355-369.

Moreover, correlations for estimating the unconfined compressive strength of rocks have been devised by several authors and are reviewed in a paper by Chang, C. entitled "Empirical Rock Strength Logging in Boreholes Penetrating Sedimentary Formations" found in MULLI-TAMSA (*Geophysical Exploration*) 7 dated 2004 at pages 174-183. Additional correlations for this purpose are described in the following papers: "Influence of Composition and Texture on Compressive Strength Variations in the Travis Peak Formation" from the 67$^{th}$ *Annual Technical Conference and Exhibition of the Society of Petroleum Engineers*, Washington, D.C. (1992) SPE 24758 by Plumb, R. A., Herron S. L. & Olsen, M. P., and "Downscaling Geomechanics Data for Thin Bed Using Petrophysical Techniques" from the 14*th SPE Middle East Oil and Gas Show and Conference*, Bahrain (2005) SPE 93605 by Qiu, K., Marsden, J. R., Solovyov, Y., Safdar, M. & Chardac, O.

SUMMARY

A method for constructing elastoplastic property correlations in multicomponent particulate systems. The method includes obtaining parameters from geophysical data of a sediment-hydrate system, where the parameters include $s_{hyd}$ and $p_c$, and where $s^{hyd}$ is a hydrate saturation and $p_c$ is a confining pressure. The method further includes determining a Young's modulus (E) of the sediment-hydrate system using the parameters and a correlation, where the correlation is $$\frac{E}{p_c} = 90.58 + \frac{78.90}{\alpha^{0.5831}} + \frac{800.4 s_{hyd}^{1.371}}{\alpha^{1.022}},$$

and where $\alpha = p_c/c$ and c is a scaling variable with dimensions of pressure. The method further includes adjusting a field operation based on the Young's modulus of the sediment-hydrate system.

Other aspects of estimating in situ mechanical properties of sediments containing gas hydrates will be apparent from the following description and the appended claims.

DETAILED DESCRIPTION

Figure 1:
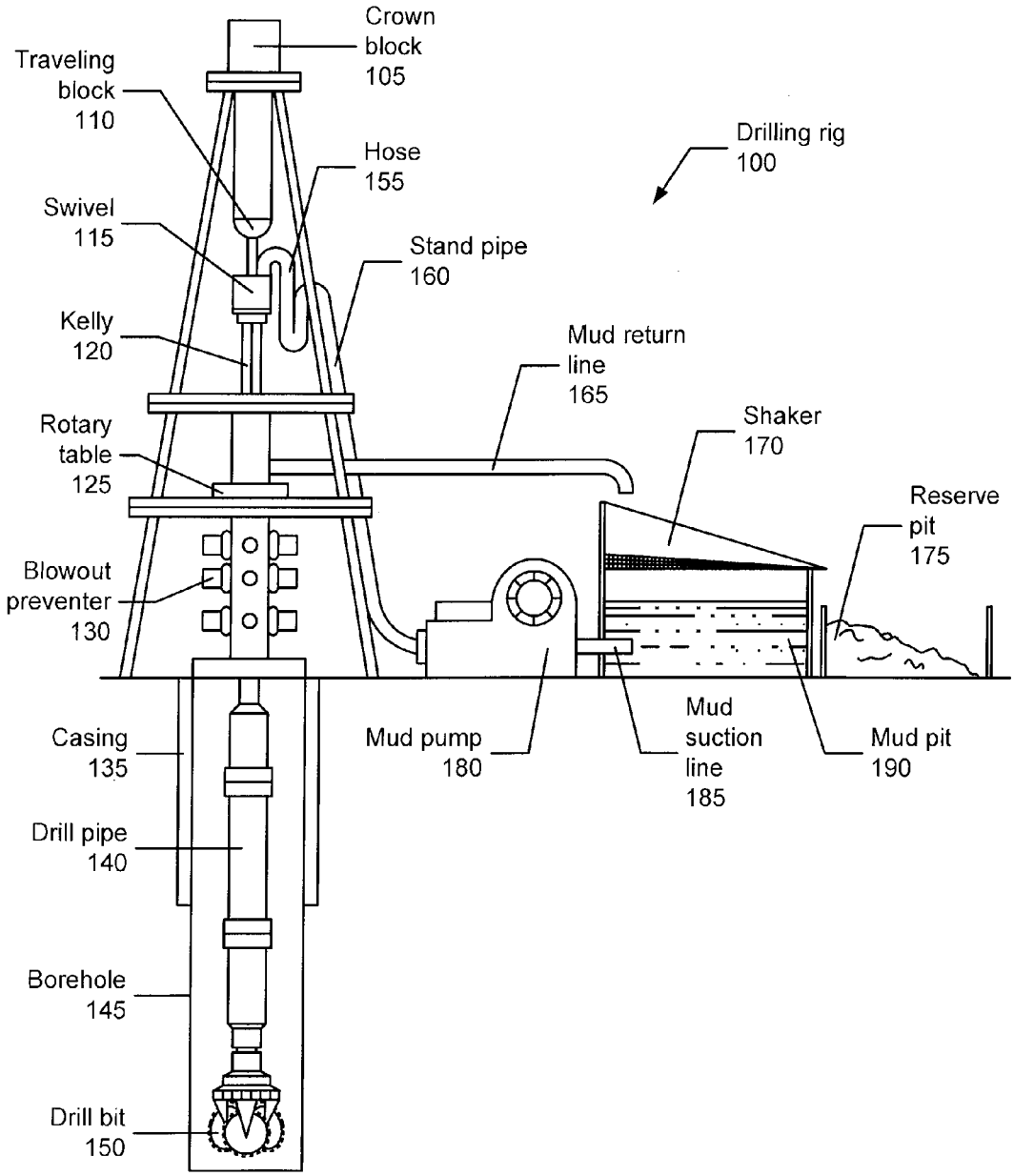
FIGURE 1 (PRIOR ART)
FIG. 1 shows a diagram of a field operation.

Specific embodiments of estimating in situ mechanical properties of sediments containing gas hydrates will now be described in detail with reference to the accompanying figures. Like elements in the various figures are denoted by like reference numerals for consistency.

In the following detailed description of embodiments of estimating in situ mechanical properties of sediments containing gas hydrates, numerous specific details are set forth in order to provide a more thorough understanding of the embodiments. However, it will be apparent to one of ordinary skill in the art that the embodiments may be practiced without these specific details. In other instances, well-known features have not been described in detail to avoid unnecessarily complicating the description.

In general, embodiments of estimating in situ mechanical properties of sediments containing gas hydrates relate to a method and system for estimating the in situ mechanical properties of sediments containing gas hydrates from seismic or log data is essential for evaluating the risks posed by mechanical failure during drilling, completions, and producing operations. More specifically, one or more embodiments relate to a method for constructing correlations between the mechanical properties of gas hydrate bearing sediments and geophysical data.

In general, embodiments of the method apply a technique using micromechanics models to guide the selection of parameters that govern the physical behavior of sediments. Based on the aforementioned selection, a set of non-dimensionalized relations between elastoplastic properties (i.e., dependent variables) and properties that may be inferred from log or seismic data (i.e., independent variables) are derived. Using these relations, the method proposes an algebraic expansion for an elastoplastic property in terms of the dependent variables and derives a correlation for the Young's modulus (E) of sands with methane and THF hydrate using data from a wide variety of sources. Those skilled in the art will appreciate that the technique for deriving the correlation is not limited to sands with methane and THF hydrate but may be extended to particulate matter in general. Those skilled in the art would also appreciate that said technique may also be used to derive other types of elastoplastic property correlations for particulate matter, such as correlations for mechanical strength, friction angle, dilation angle, etc.

In general, one or more embodiments provide a method and system for managing a field operation (e.g., drilling operation, surveying operation, completions operation, production operation, etc.) in a multicomponent particulate system (i.e., a formation that includes two or more types of particles). However, the methods described in this application may also be applied to single component systems. Geophysical, stress, and petrophysical properties of the particulate system are obtained from in situ or laboratory measurements. The choice of appropriate properties is deduced from the science of micromechanics. The geophysical and petrophysical properties referred to here are in general those of the rock frame but may also include the properties of individual particle types. They may be made dimensionless by appropriate scaling. Properties that characterize the static drained elastoplastic deformation of the particulate system are also similarly obtained and may be converted to dimensionless form. The elastoplastic properties are related to the geophysical, stress, and petrophysical properties via one or more empirical correlations. The empirical correlations are used to estimate the in situ elastoplastic properties of a sedimentary system. These properties are used in models of rock deformation and failure to assess the mechanical integrity of rocks around a borehole drilled in the sedimentary system and the field operation is adjusted based on this evaluation.

Micromechanics is the study of composite systems that aims to explain the mechanical behavior of such systems in terms of the behavior of its constitutive parts. Composite systems are those comprised of two or more parts.

Frame properties are those associated with the porous aggregate exclusive of the fluids residing inside the porous aggregate (interstitial fluids). When measuring frame properties, interstitial fluids are either removed prior to testing or the tests are carried out in such a way as to minimize their influence.

Static properties are those used to characterize the deformation of materials subject to constant or slowly varying loads. In contrast, dynamic properties characterize the deformation of materials subject to rapidly varying loads.

Drained properties are those used to characterize the deformation of materials wherein said deformation is sufficiently slow to allow the interstitial fluid to drain out of the sample without influencing the deformation.

Elastoplastic properties are properties used to model the stress-strain behavior of an elastoplastic material. Such a material exhibits an elastic response at low strains and a plastic response at high strains. During elastic deformation no permanent damage is experienced by the material. This means that when the material is unloaded, it returns to its original state prior to loading. However at sufficiently high applied loads, the material becomes plastic, i.e., it experiences permanent damage and will not return to its original state after unloading. Elastoplastic properties are used in constitutive laws that model the stress-strain response of the material in both the elastic and plastic deformation regimes.

Embodiments of estimating in situ mechanical properties of sediments containing gas hydrates may be practiced for a variety of multicomponent particulate systems. For example, field operations sometimes target formations that include clathrate hydrates (also referred to in the art as gas clathrate hydrates, gas hydrates, or clathrates). Clathrate hydrates are ice-like crystalline solids composed of a lattice of water molecules. The lattice traps gas or liquid molecules that stabilize the hydrate structure. Methane gas hydrates are the most common naturally occurring species of clathrate hydrate. However, clathrate hydrates including other hydrocarbons such as propane and ethane also exist. Further, non-hydrocarbon substances such as tetrahydrofuran (THF), carbon dioxide ($CO_2$), and hydrogen sulfide ($H_2S$) may be incorporated into the hydrate structure. Clathrate hydrates are prevalent in permafrost regions and in the deeper marine environments of continental margins.

There is increasing interest in drilling in clathrate hydrate zones. For example, clathrate hydrates may be used as an energy source. However, drilling and producing in clathrate hydrate zones may present various challenges. Temperature and pressure disturbances caused by the drilling process may lead to dissociation of clathrate hydrates, resulting in uncontrolled releases of gas into the wellbore, fires, or blowouts. Further, liberated gas may gasify the drilling mud. In some cases, wellbore instability caused by sloughing of sedimentary sections including dissociating clathrate hydrates may result in losing a hole or side tracking. See, e.g., Collett, T. S. & Dallimore, S. R. (2002) Detailed analysis of gas hydrate induced drilling and production hazards. 4$^{th}$ *International Conference on Gas Hydrates* (*ICGH*-4), Yokohama, May 2002. Even when the consequences are not catastrophic, poor hole conditions may diminish the quality of well logs in clathrate hydrate zones.

Completion and production of wells drilled in clathrate hydrate zones may also present challenges. Poor hole conditions may result in ineffective cement bonding, leading to gas leakage outside the casing. Further, loss of formation competence due to clathrate hydrate removal may cause sand production, formation subsidence, or casing failure. In addition, increased formation pressure may occur in wells completed in clathrate hydrate-bearing zones, because the production of hot hydrocarbons may lead to hydrate dissociation around a cased wellbore. See, e.g., Franklin, L. J. (1981) Hydrates in Artic Islands. In: A. L. Browser (ed.) *Proceedings of a Workshop on Clathrates* (*gas hydrates*) *in the National Petroleum Reserve in Alaska*. USGS Open-File Report 81-1259, 18-21.

Those skilled in the art will appreciate that the specific challenges discussed above are provided as examples only, as many other types of challenges exist when drilling in clathrate hydrate zones. Further, while the examples herein emphasize field operations in clathrate hydrate zones, similar challenges also exist in other types of multicomponent particulate systems. Moreover, embodiments of estimating in situ mechanical properties of sediments containing gas hydrates may be applied to single component systems or may be extended to multicomponent particulate systems that include more than two components.

Figure 2:
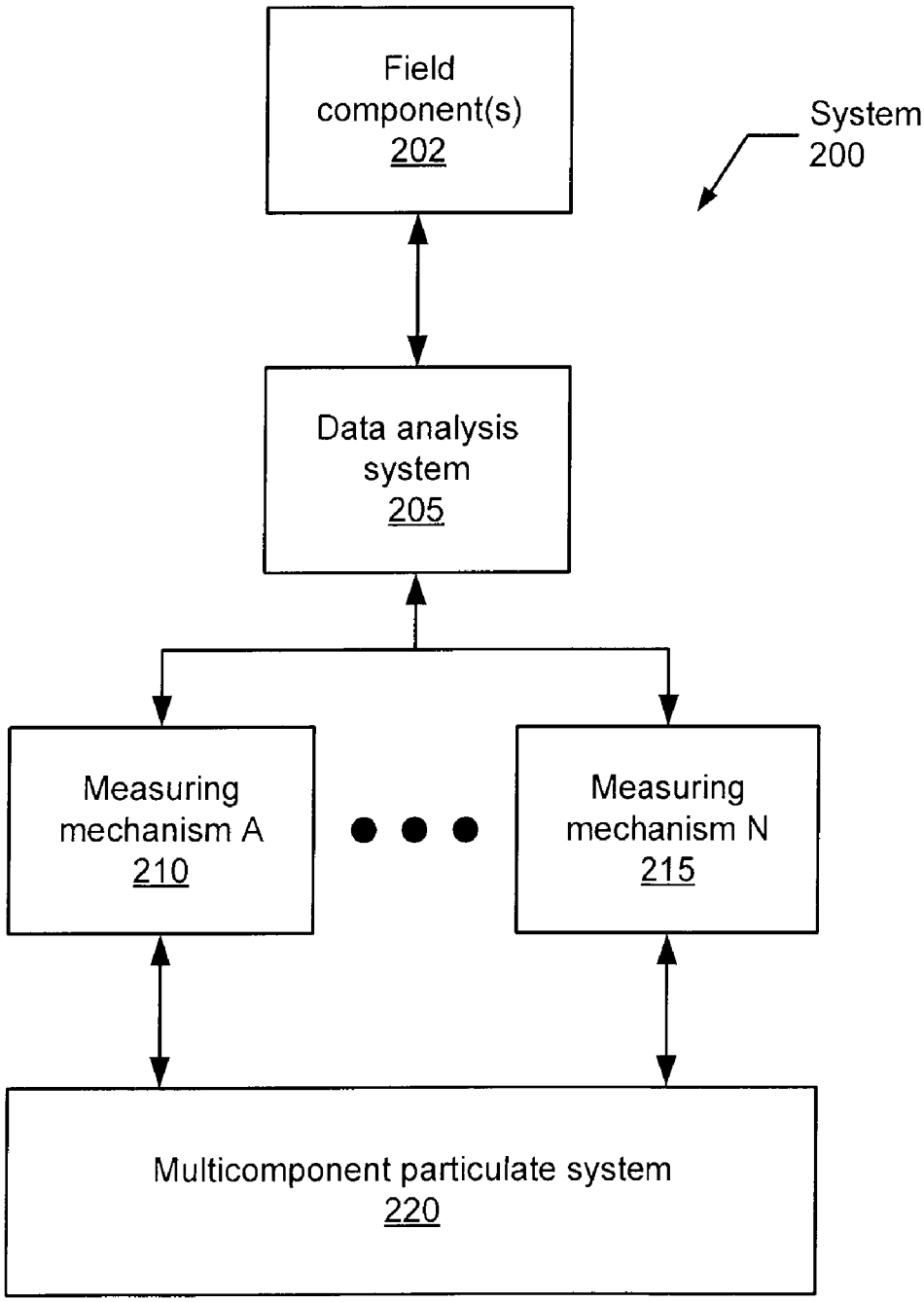
FIG. 2 shows a diagram of a system in accordance with one or more embodiments.

FIG. 2 shows a diagram of a system (200) in accordance with one or more embodiments. The system (200) includes one or more measuring mechanisms (e.g., measuring mechanism A (210), measuring mechanism N (215)) configured to measure properties of a multicomponent particulate system (220) to be drilled. Measurements may be carried out on laboratory samples or may be made in situ. Alternatively, measurements may be obtained from a simulation of the multicomponent particulate system (220), or from an actual or simulated formation having a similar composition. Because the multicomponent particulate system (220) includes two or more types of particles, separate measurements may be taken for one or more of the different types of particles.

Those skilled in the art will appreciate that many different measurable properties of multicomponent particulate systems exist, along with a variety of physical and logical mechanisms for obtaining those measurements. As one example, the measuring mechanism(s) may be configured to measure drained elastoplastic properties of the multicomponent particulate system (220) via triaxial load testing or other similar mechanical tests. As another example, the measuring mechanism(s) may be configured to measure geophysical properties (e.g., acoustic wave speeds or bulk density) of the multicomponent particulate system (220) using surface acquisition methods or borehole logging tools.

In one or more embodiments, the measuring mechanism(s) are communicatively coupled with a data analysis system (205). The data analysis system (205) is configured to process the measured properties to calculate macroscopic properties associated with elastoplastic deformation of the multicomponent particulate system (220). These properties include elastoplastic material parameters themselves or properties that are related to them such as geophysical, stress, or petrophysical attributes. A macroscopic property is one that characterizes the gross behavior of a large number of particles. It is assumed that the number of particles is sufficiently large that the sedimentary system can be treated as a continuous material (rather than a set of discrete particles) with gross properties similar to those of a continuous system. These properties represent an "average" of over all components of the system. Further, the data analysis system (205) is configured to construct a correlation (or mathematical relationship) between elastoplastic properties and geophysical, stress, or petrophysical attributes of the system. Calculating a macroscopic property and constructing an elastoplastic property correlation are discussed in detail below.

In one or more embodiments, the elastoplastic property correlation constructed by the data analysis system (205) is used to adjust one or more field component(s) (202) of a field operation in order to preserve the mechanical integrity of the sediment around the borehole. In one or more embodiments, the field component(s) (202) include one or more of the components discussed above, such as a drill bit, mud processing component(s), or casing. First, the elastoplastic property correlations are used to estimate the elastoplastic properties of the formation where drilling is planned. These properties are used as inputs to wellbore stability models designed to evaluate the mechanical integrity of rocks around a borehole. One or more field operations are adjusted based on the results of such models. Examples of adjustments include altering the density or viscosity of the mud used to drill the borehole, changing the rate at which mud is circulated through the borehole, changing the rate at which the borehole is drilled, and altering the well trajectory.

Continuing with the discussion of FIG. 2, the data analysis system (205) may be communicatively coupled with the field component(s) (202). In such cases, the data analysis system (205) may be configured to adjust the field component(s) (202) using an automated process such as an electronic switch signal or remote procedure call. Alternatively, the data analysis system (205) may be configured to present computational results in a human-readable form such as a print out or computer display, and a human operator may manually adjust the field component(s) (202) based on those results.

Figure 3:
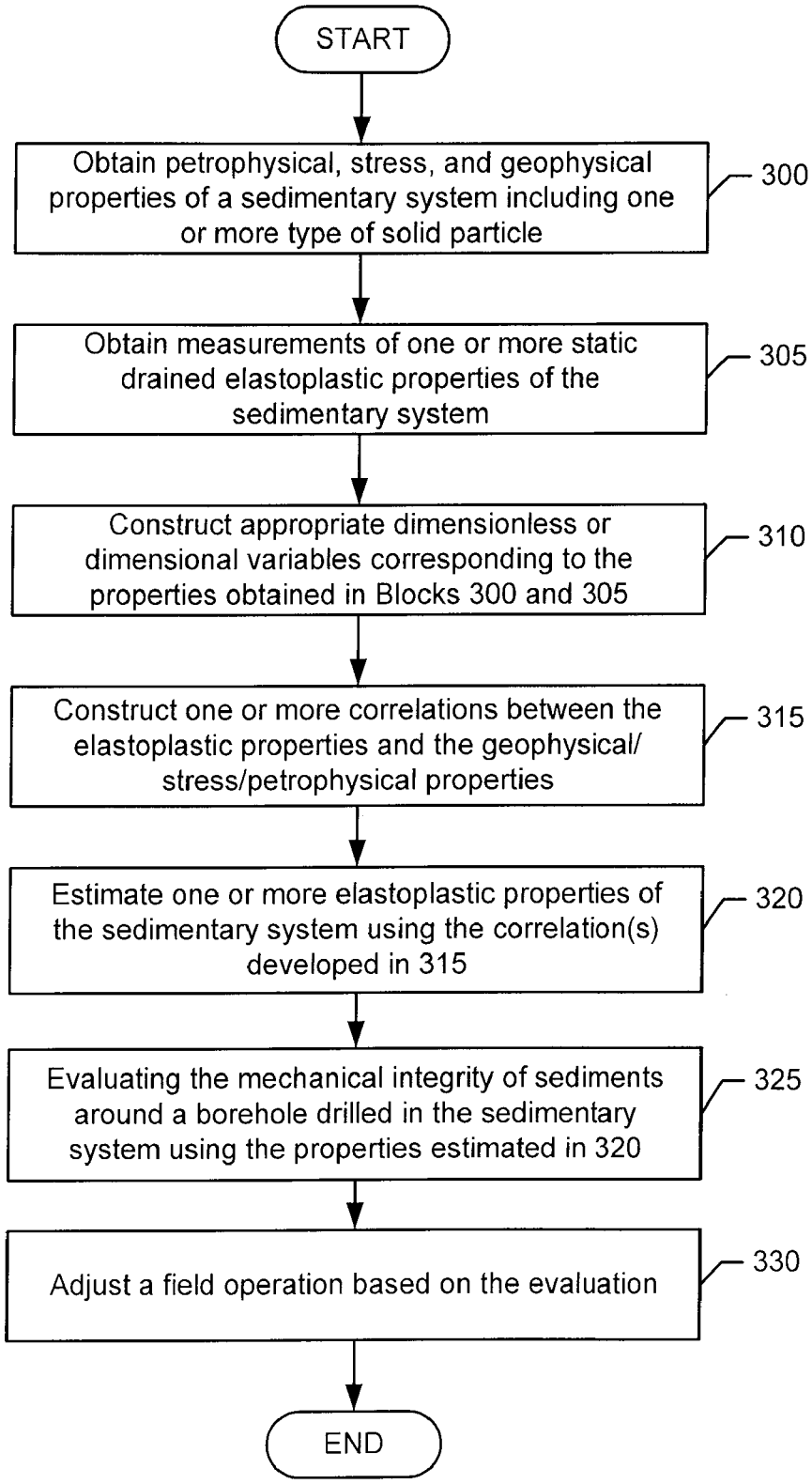
FIG. 3 shows a flowchart of a method for managing a field operation in accordance with one or more embodiments.

FIG. 3 shows a flowchart of a method for managing a field operation in accordance with one or more embodiments. In one or more embodiments, one or more of the blocks shown in FIG. 3 may be omitted, repeated, or performed in a different order. Accordingly, the specific arrangement of the method shown in FIG. 3 should not be construed as limiting the scope of estimating in situ mechanical properties of sediments containing gas hydrates.

In Block 300, geophysical, stress, and petrophysical properties (i.e., parameters) of the multicomponent system are obtained. Such properties may correspond to those of the frame or of individual particle types and may be measured by the measuring mechanism(s) discussed above. In particular, the geophysical or petrophysical data may include properties of two or more types of particles in the multicomponent particulate system, and may further include acoustic shear waves measured in the multicomponent particulate system. In Block 305, drained static elastoplastic properties of the multicomponent system are obtained. Such properties may be measured by the measuring mechanism(s) discussed above.

As noted above, the choice of geophysical, stress, and petrophysical properties is governed by micromechanical principles. In Block 310, the properties may be converted to dimensionless form or may be left in their original dimensional form. Similarly static elastoplastic properties may be converted to dimensionless form or be left in their original dimensional form. In Block 315, the elastoplastic properties are related to the petrophysical, stress and geophysical variables via one or more mathematical correlations.

In one or more embodiments, the specific form of the correlation(s) may depend on hydrate saturation levels in the multicomponent particulate system. For example, in a sediment-hydrate system, different forms may be used for low hydrate saturations versus high hydrate saturations. Accordingly, in one or more embodiments, in Block 315, a form for the elastoplastic correlation(s) is selected based on hydrate saturation levels in the multicomponent particulate system. Examples of various forms that may be applied at different hydrate saturation levels are discussed in detail below.

In Block 320, one or more elastoplastic properties are estimated using one of the correlations derived in Block 315. If a saturation-specific correlation was selected in Block 315, that correlation may be used in Block 320 to estimate one or more elastoplastic properties of the multicomponent system. In Block 325, one of more of the elastoplastic properties are estimated in Block 320 are used to model the mechanical integrity of the wellbore. In Block 330, a field operation is adjusted based on the results of such modeling.

The following discussion provides an example of the construction of an elastoplastic property correlation such as that performed in Block 315. Those skilled in the art, having benefit of the present disclosure, will appreciate that embodiments may be envisioned that differ from the following discussion while remaining within the scope of estimating in situ mechanical properties of sediments containing gas hydrates as a whole.

In one or more embodiments, elastoplastic property correlations are based on micromechanical models governing the deformation of granular materials. In the following example, a dry isotopic sediment-hydrate aggregate is assumed, in which clathrate hydrates are taken as particulate in nature. Experiments performed on glass beads that include THF hydrate suggest that this assumption may be reasonable for low to moderate hydrate saturations. See, e.g., Yang, J., Tohidi, B., & Clennell, B. M. (2004) Micro and macro-scale investigation of cementing characteristics of gas hydrates. *AAPG Hedburg Research Conference*, Vancouver, Sep. 12-16, 2004.

At high hydrate saturations, the clathrate hydrate may form a continuous matrix. Therefore, aspects of the theoretical analysis discussed below may not be strictly applicable to such cases. However, correlations devised on the basis of theories discussed herein may nonetheless be valid at high hydrate saturations.

In the following discussion, the term 'grain' refers to a mineral grain, and the term 'particle' refers to any constituent of the multicomponent particulate system (e.g., hydrate, grain, etc.), unless otherwise specified. Further, the following discussion assumes a simplified, binary model of spherical particles, in which each type of particle (e.g., hydrate, grain, etc.) has a uniform diameter and identical physical properties. Those skilled in the art will appreciate that more complex models of particulate systems may be used, in which particles are non-spherical, multi-sized, or variable in other physical properties. Moreover, as noted above, embodiments of estimating in situ mechanical properties of sediments containing gas hydrates may be extended to multicomponent particulate systems that include more than two types of particles.

Aspects of micromechanical models are described in following papers: Darve, F. & Nicot, F. (2005) On incremental non-linearity in granular media: phenomenological and multi-scale views (Part I) *International Journal for Numerical and Analytical Methods in Geomechanics,* 29, 1387-1409; Emeriault, F. & Claquin, C. (2004) Statistical homogenization for assemblies of elliptical grains: effect of the aspect ratio and particle orientation *International Journal of Solids and Structures,* 41, 5837-5849; Gardiner, B. S. & Tordesillas, A. (2004) Micromechanics of shear bands. *International Journal of Solids and Structures,* 41, 5885-5901; Sayers, C. M. (2002) Stress-dependent elastic anisotropy of sandstones. *Geophysical Prospecting,* 50, 85-95; and Tordesillas, A. & Walsh, S. (2002) Incorporating rolling resistance and contact anisotropy in micromechanical models of granular media. *Powder Technology,* 124, 106-111.

A survey and reasoned analysis of the aforementioned literature on micromechanical models suggests that drained dynamic and static deformations may be considered to involve the following physical attributes. The numbering of the physical attributes listed below is merely for the reader's convenience, and should not be construed as limiting the scope of estimating in situ mechanical properties of sediments containing gas hydrates.

1) The particle diameters of the grain ($d_g$) and the hydrate ($d_h$).

2) The densities of the grain ($\rho_g$), the hydrate ($\rho_h$), and the dry aggregate ($\rho_b$). The dry aggregate is comprised of the clathrate hydrate and the mineral grains but contains no interstitial fluids.

3) Inter-granular sliding friction coefficients that govern friction at grain-to-grain contacts ($\mu_{gg}$), hydrate-to-hydrate contacts ($\mu_{hh}$), and grain-to-hydrate contacts ($\mu_{gh}$). In one or more embodiments, these friction coefficients are considered fixed for a given sediment-hydrate combination. Alternatively, a more complex friction model may be used.

4) Cohesion at hydrate-to-hydrate contacts ($c_{hh}$) and at grain-to-hydrate contacts ($c_{gh}$). In one or more embodiments, these cohesion values are each assumed to be constant for a given sediment-hydrate combination. Further, as is generally assumed for unconsolidated sediments, cohesion at grain-to-grain contacts may be treated as negligible or non-existent. Alternatively, a more complex cohesion model may be used.

5) Contact density distribution functions that describe the expectation of finding contacts in a given direction. In this example, four such distributions are used, governing grain-to-grain, grain-to-hydrate, hydrate-to-grain, and hydrate-to-hydrate contacts. In a triaxial test conducted on an isotropic material, the contact density distribution functions are independent of orientation in the initial isotropic stress state, prior to axial compression. As axial compression occurs, the contact density distribution functions generally evolve and become dependent on angular orientation. See, e.g., Darve, F. & Nicot, F. (2005) On incremental non-linearity in granular media: phenomenological and multi-scale views (Part I). *International Journal for Numerical and Analytical Methods in Geomechanics,* 29, 1387-1409. However, the evolution described above is wholly determined by the initial contact density distribution functions, the applied stresses, and the properties defined herein. Thus, it may only be necessary to specify the contact density distribution functions in the initial isotropic stress state.

For such states, mean partial coordination numbers and the quantities of various types of particles may be substituted for contact density distribution functions. Thus, the deformation process may be assumed to depend on the number of grains per unit volume ($n_g$), the number of hydrate particles per unit volume ($n_h$), and the mean partial coordination numbers ($N_{gg}$, $N_{gh}$, $N_{hg}$, and $N_{hh}$), whereas above, the subscripts represent the nature of the contact. Because $n_g N_{gh} = n_h N_{hg}$, one or more embodiments may not require the specification of $N_{hg}$. Alternatively, another variable may be omitted from specification.

6) Distribution functions for the coordination numbers of each type of particle contact (grain-grain, grain-hydrate, hydrate-grain, hydrate-hydrate). At the time of this writing, no theory has been developed for the distributed coordination numbers of multicomponent particulate systems, and few experiments have been performed to measure these distributions. See, e.g., Pinson, D., Zou, R. P., Yu, A. B., Zulli, P. & McCarthy, M. J. (1998) Coordination number of binary mixtures of spheres. J. Phys. D, 31, 457-462. Thus, only the mean values of these distributions ($N_{gg}$, $N_{gh}$, and $N_{hh}$) may be specified. In other words, the roles of higher order moments may be neglected. However, if a theory for the distributed coordination numbers of multicomponent particulate systems is developed, the theory may be used to obtain the distributed coordination numbers.

7) The normal and shear elastic stiffnesses of particulate contacts. Generally, these elastic stiffnesses vary from contact to contact, depending on the applied stress and the material properties of the particles making contact. However, these stiffnesses may be assumed to be known if the elastic properties of the grains are known and sufficient information exists to calculate the stresses at each contact. For example, this assumption may be made if the geometrical structure of the multicomponent particulate system and confining pressure are defined. In one or more embodiments, the variables discussed above ($N_{gg}$, $N_{gh}$, $N_{hh}$, $n_h$, $n_g$, $d_g$, and $d_h$) may be considered sufficient to define the geometrical structure of the multicomponent particulate system. Thus, the additional variables required to specify the normal and shear elastic stiffnesses of particulate contacts, are Young's moduli for the grain and hydrate ($E_g$, $E_h$); Poisson's ratios for the grain and hydrate ($\nu_g$, $\nu_h$); and confining pressure ($p_c$).

For the purposes of this discussion, clathrate hydrate content is excluded from the list of physical attributes under consideration. Clathrate hydrate content affects deformation insofar as it exerts control over physical properties that are already included in the list.

In one or more embodiments, the multicomponent particulate system may be assumed to deform plastically via sliding at grain contacts. Accordingly, the contribution of particle rotation to deformation may be ignored. Rolling contact, rather than sliding contact, is expected to dominate the final stages of shear banding. See, e.g., Bardet, J. P. & Proubet, J. (1991) A numerical investigation of the structure of persistent shear bands in granular media. *Geotechnique,* 41, 599-613; and Tordesillas, A. & Walsh, S. (2002) Incorporating rolling resistance and contact anisotropy in micromechanical models of granular media. *Powder Technology,* 124, 106-111. Alternatively, particle rotation may be incorporated into the analysis by specifying additional parameters to describe the rolling resistance and rotational stiffness at contacts.

Based on the discussion above, a macroscopic property $\eta$ that governs elastoplastic deformation may be considered to depend on the following parameters:

$$\eta=\eta(d_g, d_h, \rho_g, \rho_h, \rho_b, E_g, E_h, \nu_g, \nu_h, \mu_{gg}, \mu_{gh}, \mu_{hh}, c_{gh}, c_{hh}, N_{gg}, N_{gh}, N_{hh}, n_g, n_h, p_c) \quad (1)$$

Further, equation (1) may be modified based on the following relations, where $\phi$ is porosity and $s_{hyd}$ is hydrate saturation:

$$(1-\varphi) = \frac{1}{6}\pi d_g^3 n_g \quad (2)$$

$$\varphi s_{hyd} = \frac{1}{6}\pi d_h^3 n_h \quad (3)$$

$$\rho_b=(1-\phi)\rho_g+s_{hyd}\phi\rho_h \quad (4)$$

Accordingly, using equations (2), (3) and (4) to eliminate $n_g$, $d_h$ and $\rho_h$ in equation (1) yields:

$$\eta=\eta(d_g, s_{hyd}, \rho_g, \rho_b, E_g, E_h, \nu_g, \nu_h, \mu_{gg}, \mu_{gh}, \mu_{hh}, c_{gh}, c_{hh}, N_{gg}, N_{gh}, N_{hh}, \phi, n_h, p_c) \quad (5)$$

The choice of which variables to eliminate in equation (5) is not unique. Equation (5) defines variables that control elastoplastic properties of the multicomponent particulate system, including acoustic velocities which may be expressed as follows:

$$V_p=V_p(d_g, s_{hyd}, \rho_g, \rho_b, E_g, E_h, \nu_g, \nu_h, N_{gg}, N_{gh}, N_{hh}, \phi, n_h, p_c) \quad (6)$$

$$V_s=V_s(d_g, s_{hyd}, \rho_g, \rho_b, E_g, E_h, \nu_g, \nu_h, N_{gg}, N_{gh}, N_{hh}, \phi, n_h, p_c) \quad (7)$$

where $V_p$ is the compressional wave velocity and $V_s$ is the shear wave velocity.

In this example, both acoustic velocities are frame velocities. Further, where necessary, acoustic velocities measured in fluid-saturated sediments may be corrected using Gassman's relations or any other similar method. See, e.g., Mavko, G., Mukerji, T., & Dvorkin, J. (1998) *The Rock Physics Handbook.* Cambridge University Press. p. 329. In equations (6) and (7), acoustic waves are assumed to induce strains that are too small to produce slip at contacts. Therefore, $V_p$ and $V_s$ may be considered independent of the cohesive and frictional properties at contacts.

Continuing with the example above, it may be assumed that equation (6) can be inverted for $N_{gg}$. Specifically, if all the other variables in equation (6) are fixed, a one-to-one relation between $V_p$ and $N_{gg}$ may be assumed. This assumption is physically reasonable, because $V_p$ is expected to increase monotonically with $N_{gg}$. Consequently $N_{gg}$ may be replaced in equation (5) by $V_p$ so that:

$$\eta=\eta(d_g, s_{hyd}, \rho_g, \rho_b, E_g, E_h, \nu_g, \nu_h, \mu_{gg}, \mu_{gh}, \mu_{hh}, c_{gh}, c_{hh}, V_p, N_{gh}, N_{hh}, \phi, n_h, p_c) \quad (8)$$

In one or more embodiments, $V_s$ may be substituted for $V_p$. Further, at low hydrate saturations, mechanical properties may be considered independent of the properties of the hydrate. This assumption is expected to apply if the hydrates grow in the pore space rather than in the grain contact region after nucleation. Consequently, equation (8) may be reduced to:

$$\eta_{low}=\eta_{low}(d_g, \rho_g, \rho_b, E_g, \nu_g, \mu_{gg}, V_p, \phi, p_c) \quad (9)$$

However, at moderate to high hydrate saturations, hydrate particles become load bearing and the geometrical and physical properties of the hydrate particles become important. In such circumstances, $V_s$ may be sensitive to these properties.

Further, it may be assumed that equation (7) can be inverted for $N_{hh}$. That is, if all the other variables in equation (7) are fixed, a one-to-one relation between $V_s$ and $N_{hh}$ may exist. This one-to-one relationship is again physically reasonable, because $V_s$ is expected to increase monotonically as the number of contacts between neighboring hydrate particles increases. Consequently, $N_{hh}$ may be replaced in equation (8) by $V_s$ so that:

$$\eta_{high}=\eta_{low}(d_g, s_{hyd}, \rho_g, \rho_b, E_g, E_h, \nu_g, \nu_h, \mu_{gg}, \mu_{gh}, \mu_{hh}, c_{gh}, c_{hh}, V_p, N_{gh}, V_s, \phi, n_h, p_c) \quad (10)$$

Equations (9) and (10) are general relations that may be used for the construction of elastoplastic property correlations. However, these equations may be cumbersome to apply in some circumstances. Accordingly, the equations may be simplified to facilitate their application. The following is a discussion of one such set of simplifications. The following simplifications are provided for exemplary purposes only and should not be construed as limiting the scope of estimating in situ mechanical properties of sediments containing gas hydrates.

As one example, equations (9) and (10) may be simplified by applying them to a given binary sediment-hydrate system (alternatively, equations (9) and (10) may be used to construct correlations for the combined data of several different binary systems). By virtue of assumptions discussed above, $d_g$, $r_g$, $E_g$, $E_h$, $\nu_g$, $\nu_h$, $\mu_{gg}$, $\mu_{gh}$, $\mu_{hh}$, $c_{gh}$, and $c_{hh}$ may be considered fixed for a given sediment-hydrate combination.

Eliminating $N_{gh}$ and $n_h$ from equation (10) may be desirable. At the time of this writing, exact theoretical expressions for the three mean partial coordination numbers ($N_{gg}$, $N_{gh}$, and $N_{hh}$) do not exist. However, approximate theoretical relations for the partial mean coordination numbers of multimodal particulate systems are described in the following papers: Dodds, J. A. (1980) The porosity and contact points in multicomponent random sphere packings calculated by a simple statistical geometric model. *J. Colloid Interface Sci.* 77, 317-327; Ouchiyama, N. & Tanaka, T. (1980) Estimation of the average number of contacts between randomly mixed solid particles. *Ind. Eng. Chem. Fundam.* 19, 338-340; and Suzuki, M. & Oshima, T. (1985) Co-ordination number of a multicomponent randomly packed bed of spheres with size distribution. *Powder Technol.* 44, 213.

An examination of the expressions developed by Ouchiyama & Tanaka (1980) (referenced above) reveals that $N_{gg}$, $N_{gh}$, and $N_{hh}$ may be modeled approximately as follows:

$$N_{gg}, N_{gh}, N_{hh}=f(n_g, n_h, d_h, d_g, \phi) \quad (11)$$

Further, $n_g$ and $d_h$ may be eliminated as before, using equations (2) and (3). Thus, equation (11) may be simplified as:

$$N_{gg}, N_{gh}, N_{hh}=f(n_h, s_{hyd}, d_g, \phi) \quad (12)$$

Moreover, due to the simplicity of the relations of Ouchiyama & Tanaka (1980) (referenced above), equation (12) may be inverted to obtain $n_h$ in terms of $N_{hh}$ so that:

$$n_h=n_h(N_{hh}, s_{hyd}, d_g, \phi) \quad (13)$$

Substituting equation (13) into equation (12) gives the following relation for $N_{gh}$:

$$N_{gh}=N_{gh}(N_{hh}, s_{hyd}, d_g, \phi) \quad (14)$$

Finally for this example, substituting equations (13) and (14) into equation (10) and making use of the fact that equation (7) may be inverted to give $N_{hh}$ in terms of $V_s$ gives:

$$\eta_{high}=\eta_{high}(d_g, s_{hyd}, \rho_g, \rho_b, E_h, E_h, \nu_g, \nu_h, \mu_{gg}, \mu_{gh}, \mu_{hh}, c_{gh}, c_{hh}, V_p, V_s, \phi, p_c) \quad (15)$$

Dimensional analysis may be employed to reduce the number of independent variables in equations (9) and (15). In general, the macroscopic property $\eta$ may be considered either dimensionless (e.g., Poisson's ratio, dilation angle) or having the dimensions of pressure (e.g., Young's modulus, unconfined compression strength (UCS), cohesion hardening parameters, etc.). For purposes of non-dimensionalization, $d_g$, $\rho_g$, and $V_p$ may be selected as scaling variables. However, other combinations of scaling variables may be used (e.g., $\{p_c, d_g, \rho_g\}$, $\{p_c, d_g, V_p\}$). Further, the resulting relations may be used exclusively or in combination with other relations.

With this choice of scaling variables, the terms $E_g$, $E_h$, $c_{gh}$, and $c_{hh}$ (which have dimensions of pressure) may be scaled by the quantity $\rho_g V_p^2$, leading to four dimensionless variables of the form $$\frac{c}{\rho_g V_p^2},$$

where c is constant for a fixed sediment-hydrate combination. However, without loss of generality, all four variables may be replaced by a single variable $$c^* = \frac{c}{\rho_g V_p^2},$$

where c is an arbitrary scaling variable with dimensions of pressure.

Non-dimensionalizing may therefore lead to the following relations between dimensionless quantities:

$$\eta^*_{low}=\eta^*_{low}(\rho^*, c^*, \nu_g, \mu_{gg}, \phi, p^*_c) \quad (16)$$

$$\eta^*_{high}=\eta^*_{high}(s_{hyd}, \rho^*, c^*, \nu_g, \nu_h, \mu_{gg}, \mu_{gh}, \mu_{hh}, \gamma, \phi, p^*_c) \quad (17)$$

where $\eta^*=\eta/\mu_g V_p^2$ if $\eta$ has dimensions of pressure, $\eta^*=\eta$ if $\eta$ is dimensionless, $$\rho^* = \frac{\rho_b}{\rho_g}, \gamma = \frac{V_p}{V_s}, \text{ and } p_c^* = \frac{p_c}{\rho_g V_p^2}.$$

Equations (16) and (17) provide a basis for devising correlations between mechanical properties and geophysical data in a binary sediment-hydrate system. For a fixed sediment-hydrate combination, $\nu_g$, $\nu_h$, $\mu_{gg}$, $\mu_{gh}$ and $\mu_{hh}$ are fixed, so that correlations only need to be sought among the remaining variables. The independent variables, $s_{hyd}$, $\rho^*$, $c^*$, $\gamma$, $\phi$, and $p^*_c$ may all be measured or inferred from geophysical data.

Figure 4:
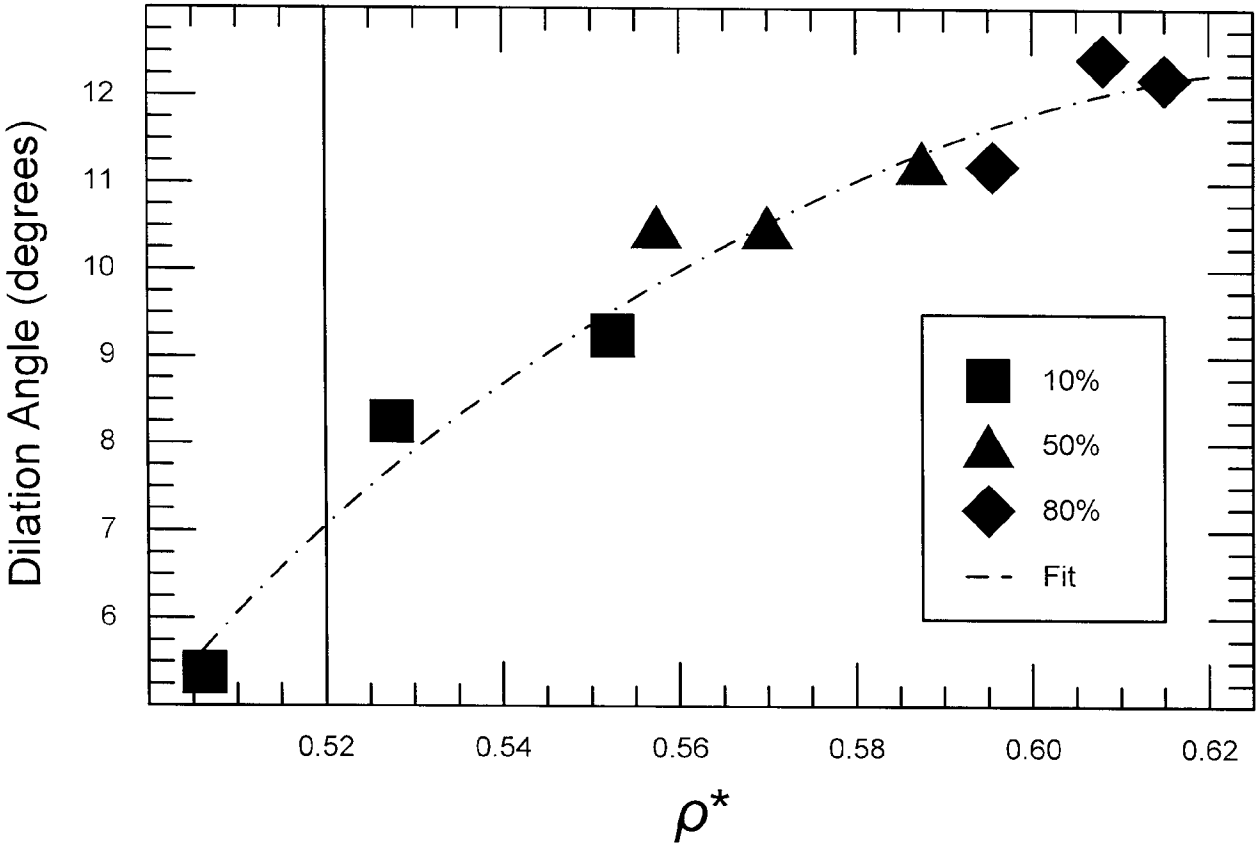
FIG. 4 shows a diagram of a correlation in accordance with one or more embodiments.

FIG. 4 shows a diagram of a correlation in accordance with one or more embodiments. Specifically, FIG. 4 shows a diagram of an exemplary correlation (broken dashed line) between the dilation angle and the dimensionless bulk density, $\rho^*$ constructed using hypothetical data, according to the exemplary equations discussed above. The dilation angle is a measure of the tendency of a solid to increase its volume when subject to shearing. In FIG. 4, hydrate saturation corresponds to data points shown in the legend. In practice, the data shown in FIG. 4 may be acquired using the following procedures. Samples of a hydrate bearing sediment are obtained either by coring formations of interest or by manufacturing synthetic substitutes in a laboratory. The properties $\rho_b$ and $\rho_g$ of the samples are measured in the laboratory and $\rho^*$ is calculated. The samples are then subjected to compression in a triaxial test device under various loading regimes. Stress-strain curves are plotted for the sample. The dilation angle is deduced from these stress-strain curves. A plot of dilation angle vs. $\rho^*$ is constructed and a curve is fitted to the points on the plot. The mathematical function describing this curve is in fact the correlation between the dilation angle and $\rho^*$.

Although a good correlation between the dilation angle and $\rho^*$ has been assumed in this example, in practice, a search is typically performed to find the combination of variables in equations (16) and (17) that correlate best. For example, it may turn out that the dilation angle correlates best with the product $\rho^*\gamma$ or with the three variables $s_{hyd}$, $\rho^*$ and $\phi$. Those skilled in the art will appreciate that many types of correlations exist. The correlation shown in FIG. 4 is provided for exemplary purposes only and should not be construed as limiting the scope of estimating in situ mechanical properties of sediments containing gas hydrates.

Embodiments of estimating in situ mechanical properties of sediments containing gas hydrates allow for accurate prediction of mechanical properties of multicomponent particulate systems (for example sediments that include clathrate hydrates). By accounting for mechanical effects in such systems, one or more embodiments may avoid inefficient operational practices associated with overly conservative mechanical failure models and elastic-brittle models. For example, embodiments may be used to forecast rock deformation or failure, and a field operation may be adjusted based on the forecast. More generally, embodiments allow a field operation to be adjusted to mitigate challenges associated with drilling in multicomponent particulate system.

In one or more embodiments, using the methods described above with respect to equations (1)-(17) and in U.S. Pat. No. 7,472,022, the following equations are derived:

$$\eta^*_{low}=\eta^*_{low}(\alpha^*,V^*_p,\phi) \tag{18}$$

$$\eta^*_{high}=\eta^*_{high}(s_{hyd},\alpha^*,V^*_p,V^*_s,\phi) \tag{19}$$

where all terms appearing in equations (18) and (19) denoted by an asterisk are dimensionless. Specifically, $\eta^*_{low}$, $\eta^*_{high}$ are dimensionless mechanical properties at low and high gas hydrate saturation respectively; $\alpha^*$, $V^*_p$, and $V^*_s$ are the dimensionless confining pressure, compressional wave velocity, and shear wave velocity, respectively; $s_{hyd}$ is the hydrate saturation, $\phi$ is the porosity; and the mechanical properties on the left hand side with units of pressure are scaled by the confining pressure, $p_c$. The non-dimensionalized terms are defined as follows:

$$\alpha^* = \frac{p_c}{c},\ V_p^* = V_p\sqrt{\frac{\rho_g}{p_c}},\ \text{and}\ V_s^* = V_s\sqrt{\frac{\rho_g}{p_c}},$$

where c is an arbitrary scaling variable with dimensions of pressure, $V_p$ and $V_s$ are the compressional and shear wave velocities respectively, and $\rho_g$ is the density. In one or more embodiments, some of the independent variables may not be available. In this case, correlations may be derived by performing a search over a subset of the full complement of variables. For example, if the acoustic velocities, $V_p$ and $V_s$, are not available, equations (18) and (19) may be used to derive a correlation between the dimensionless static drained Young's modulus ($E/p_c$) and the independent variables $s_{hyd}$, $\alpha^*$, and $\phi$. In one or embodiments, the independent variables $s_{hyd}$,$\alpha^*$,$\phi$ may be measured or inferred from geophysical data along with the scaling constant, $p_c$. For convenience, the asterisks appearing in the superscript positions of dimensionless variables is not included in the equations below.

In one or more embodiments of the invention, equation (19) is expanded as follows:

$$\eta^*=a_0+a_1\phi^{n1}+a_2 s_{hyd}^{n2}+a_3\alpha^{n3}+a_4\phi^{n1}s_{hyd}^{n2}+a_5\alpha^{n3}\phi_{hyd}^{n4}+a_6\alpha^{n5}s_{hyd}^{n6} \tag{20}$$

In this example, equation (20) is used if the acoustic velocities $V_p$, $V_s$, are not available. The expanded form of equation (19) allows for second-order coupling between the independent variables ($s_{hyd}$,$\alpha$,$\phi$). Those skilled in the art would appreciate that alternative expansions are possible, for example, higher order algebraic terms, or non-algebraic terms may be used. Further, expansions may also include dimensional variables, terms related to the acoustic velocities, or various combinations of the terms appearing on the right hand sides of equations (8), (9) and/or (16). A numerical search scheme along with data from the field (or sample data) may then be used to eliminate redundant terms from the expansion and determine the optimal values for the remaining coefficients. In this case, redundant terms may correspond to terms that are insensitive to the laboratory data (i.e., terms that fail to improve the ability of the correlation to fit of the laboratory data). In one or more embodiments, an iteration of Bayesian inversion is performed to obtain the values of the coefficients that produce the best match with laboratory data. Coefficients with the greatest uncertainty (i.e., the least sensitivity to the data) are dropped from the expansion and another iteration of inversion may be performed. The process may be repeated until no further terms can be dropped.

In one or more embodiments, the following correlation is determined using the aforementioned Bayesian search scheme:

$$\frac{E}{p_c} = A + \frac{B}{\alpha^C} + \frac{Ds_{hyd}^E}{\alpha^F} \tag{21}$$

where A=90.58, B=78.90, C=0.5831, D=800.4, E=1.371, and F=1.022. In this example, the correlation accounts for second-order coupling between $\alpha$ and $s_{hyd}$. The use of a generalized expansion technique allows such couplings to be discovered. Further, the use of a generalized expansion allows correlations to be produced without the biases associated with imposing a predetermined form of the correlation.

Those skilled in the art will appreciate that the generalized expansion technique and the result produced (e.g., equation (21)) may utilize laboratory measurements of the mechanical properties of hydrate bearing sediments that are relatively recent. Further, the sequential elimination of terms from the expansion via Bayesian inversion requires significant computational resources.

In one or more embodiments, the results derived from applying the correlation of equation (21) indicated the Young's modulus at high clathrate hydrate saturations may be underpredicted. In this case, the aforementioned correlation (equation (21)) may be used when the following conditions are satisfied: (i) clathrate hydrate saturation is not substantially greater than 50% and (ii) the confining pressure is within the range of 50 kPa$\leqq p_c \leqq$1 MPa. Those skilled in the art will appreciate that the correlation may be used when the aforementioned conditions are not satisfied. Further, those skilled in the art will appreciate that the constants in the aforementioned correlation, or the form of the correlation, may be different based on which gas hydrates are present in the sand and/or other physical properties of the sand or environment from which the data is obtained for use with the numerical search scheme.

Figure 5:
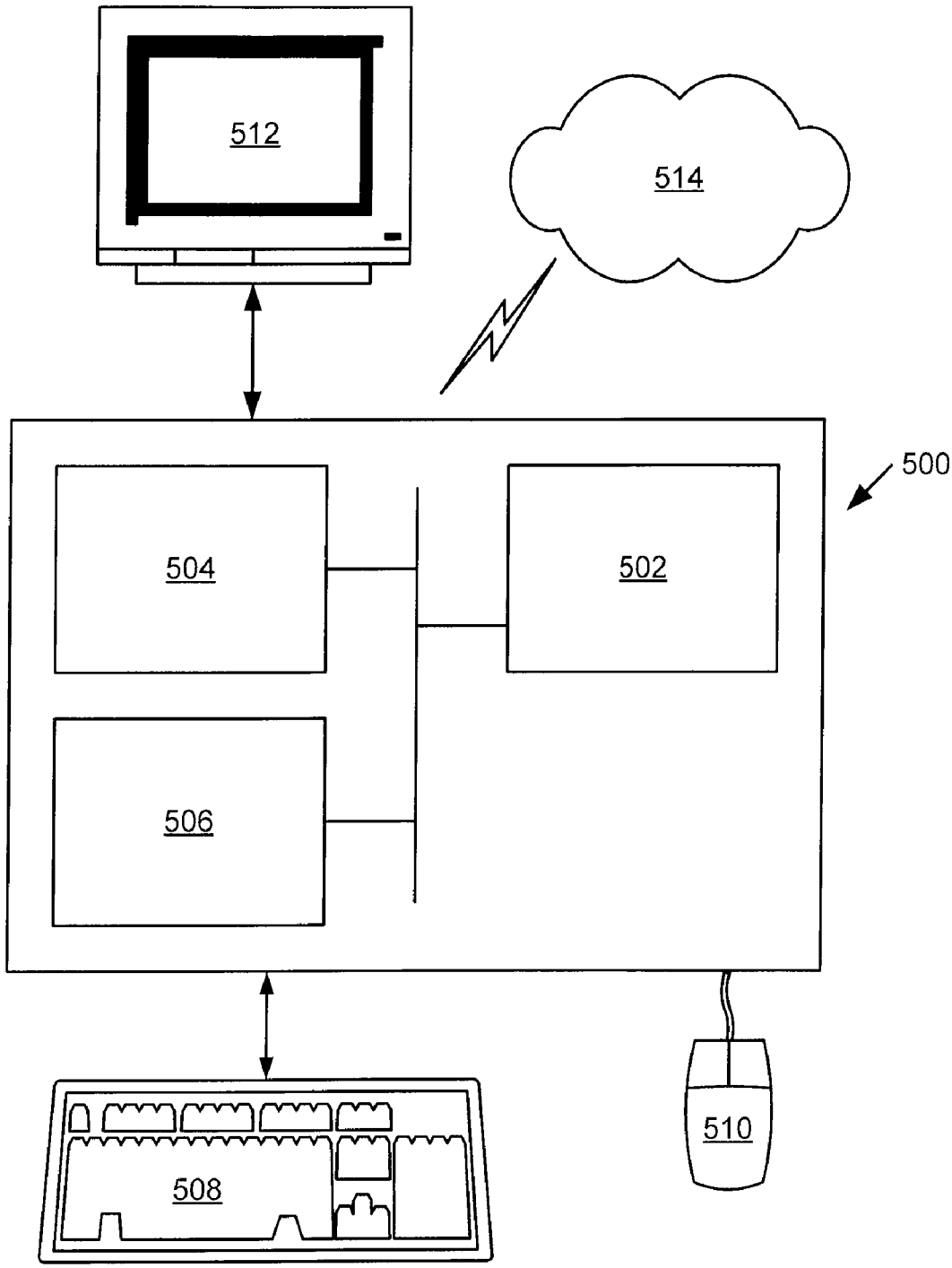
FIG. 5 shows a diagram of a computer system in accordance with one or more embodiments.

Embodiments may be implemented on virtually any type of computer regardless of the platform being used. For example, as shown in FIG. 5, a computer system (500) includes a processor (502), associated memory (504), a storage device (506), and numerous other elements and functionalities typical of today's computers (not shown). The computer (500) may also include input means, such as a keyboard (508) and a mouse (510), and output means, such as a monitor (512). The computer system (500) may be connected to a network (514) (e.g., a local area network (LAN), a wide area network (WAN) such as the Internet, or any other similar type of network) via a network interface connection (not shown). Those skilled in the art will appreciate that these input and output means may take other forms.

Further, those skilled in the art will appreciate that one or more elements of the aforementioned computer system (500) may be located at a remote location and connected to the other elements over a network. Further, one or more embodiments may be implemented on a distributed system having a plurality of nodes, where each portion of the system (e.g., field component(s), data analysis system, measuring mechanism(s), etc.) may be located on a different node within the distributed system. In one or more embodiments, the node corresponds to a computer system. Alternatively, the node may correspond to a processor with associated physical memory. The node may alternatively correspond to a processor with shared memory or resources. Further, software instructions to perform embodiments of the method may be stored on a computer readable medium such as a compact disc (CD), a diskette, a tape, or any other computer readable storage device.

While estimating in situ mechanical properties of sediments containing gas hydrates has been described with respect to a limited number of embodiments, those skilled in the art, having benefit of this disclosure, will appreciate that other embodiments can be devised which do not depart from the scope of estimating in situ mechanical properties of sediments containing gas hydrates as disclosed herein. Accordingly, the scope of estimating in situ mechanical properties of sediments containing gas hydrates should be limited only by the attached claims.

What is claimed is:

1. A method for constructing elastoplastic property correlations in multicomponent particulate systems, comprising:

obtaining parameters from geophysical data of a sediment-hydrate system, wherein the parameters comprise $s_{hyd}$ and $p_c$, and wherein $s_{hyd}$ is a hydrate saturation and $p_c$ is a confining pressure;

determining, using a computer processor, a Young's modulus (E) of the sediment-hydrate system using the parameters and a correlation, wherein the correlation is $$\frac{E}{p_c} = 90.58 + \frac{78.90}{\alpha^{0.5831}} + \frac{800.4 s_{hyd}^{1.371}}{\alpha^{1.022}},$$

and wherein $\alpha = p_c/c$ and c is a scaling variable with dimensions of pressure; and adjusting a field operation based on the Young's modulus of the sediment-hydrate system.

2. The method of claim 1, wherein clathrate hydrate saturation in the sediment-hydrate system is not substantially greater than fifty percent.

3. The method of claim 2, wherein $p_c$ is within a range of 50 kPa$\leqq p_c \leqq$1 MPa.

4. The method of claim 1, wherein the sediment-hydrate system comprises methane hydrate.

5. The method of claim 1, wherein the sediment-hydrate system comprises tetrahydrofuran hydrate.

6. The method of claim 1, wherein c is set at 1 MPa.

7. The method of claim 1, wherein the field operation is associated with well completion.

8. The method of claim 1, wherein the field operation is associated with well production.

9. A method for managing a field operation in a multicomponent particulate system, comprising:

obtaining at least one of a plurality of geophysical and petrophysical parameters associated with the multicomponent particulate system;

calculating at least one property corresponding to the plurality of geophysical and petrophysical parameters;

obtaining at least one measurement of an elastoplastic property of the multicomponent particulate system;

predicting at least one elastoplastic property of the multicomponent particulate system using the at least one measurement of the elastoplastic property of the multicomponent particulate system and the at least one property;

constructing a correlation for the at least one elastoplastic property based on a general expansion that relates the at least one elastoplastic property to the at least one property;

using a numerical search scheme to eliminate redundant terms from the general expansion;

estimating, using a computer processor, at least one elastoplastic property of sediments in a formation of interest using the correlation;

evaluating mechanical integrity of the formation of interest using the at least one elastoplastic property of sediments; and adjusting the field operation based on the evaluation.

10. The method of claim 9, wherein the plurality of geophysical and petrophysical parameters comprises at least one selected from a group consisting of volumetric fractions of various types of particles in the multicomponent particulate system, porosity of the multicomponent particulate system, acoustic velocities measured in the multicomponent particulate system, and effective confining pressure of the multicomponent particulate system.

11. The method of claim 9, wherein the at least one elastoplastic property is a Young's Modulus, and wherein the correlation is $$\frac{E}{p_c} = A + \frac{B}{\alpha^C} + \frac{D s_{hyd}^E}{\alpha^F},$$

wherein A, B, C, D, E, and F are constants, $p_c$ is a confining pressure with dimensions of pressure, $\alpha$ is a dimensionless confining pressure, and $s_{hyd}$ is a hydrate saturation.

12. The method of claim 9, wherein each of the at least one elastoplastic property and the at least one property are dimensionless.

13. The method of claim 11, wherein A=90.58, B=78.90, C=0.5831, D=800.4, E=1.371, and F=1.022.

14. The method of claim 9, wherein the multicomponent particulate system is a sediment-hydrate system.

15. A system for constructing elastoplastic property correlations in multicomponent particulate systems, comprising:

at least one measuring mechanism configured to retrieve parameters from geophysical data of a sediment-hydrate system, wherein the parameters comprise $S_{hyd}$ and $p_c$, and wherein $S_{hyd}$ is a hydrate saturation and $p_c$ is a confining pressure;

a data analysis system configured to:

construct a correlation between the Young's modulus (E) and at least one property of the geophysical data, wherein the correlation is:

$$\frac{E}{p_c} = 90.58 + \frac{78.90}{\alpha^{0.5831}} + \frac{800.4 s_{hyd}^{1.371}}{\alpha^{1.022}},$$

and wherein $\alpha = p_c/c$ and c is a scaling variable with dimensions of pressure; and determine the Young's modulus of the sediment-hydrate system using the parameters and the correlation; and at least one field component configured to adjust a field operation based on the Young's modulus of the sediment-hydrate system.

16. The system of claim 15, wherein the data analysis system is further configured to determine the Young's modulus when clathrate hydrate saturation in the sediment-hydrate system is not substantially greater than fifty percent, and wherein $p_c$ is within a range of 50 kPa$\leqq p_c \leqq$1 MPa.

17. The system of claim 15, wherein the sediment-hydrate system comprises methane hydrate.

18. The system of claim 15, wherein the sediment-hydrate system comprises tetrahydrofuran hydrate.

19. The system of claim 15, wherein the at least one field component is associated with well completion.

20. The system of claim 15, wherein the at least one field component is associated with well production.

* * * * *